US011170685B2

(12) United States Patent
Liao et al.

(10) Patent No.: US 11,170,685 B2
(45) Date of Patent: Nov. 9, 2021

(54) DISPLAY DEVICE AND DRIVING DEVICE THEREOF

(71) Applicant: NOVATEK MICROELECTRONICS CORP., Hsinchu (TW)

(72) Inventors: Jhih-Ming Liao, Hsinchu (TW); Chun-Yu Liao, Kaohsiung (TW); Teng-Jui Yu, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/008,813

(22) Filed: Sep. 1, 2020

(65) Prior Publication Data

US 2021/0312847 A1 Oct. 7, 2021

Related U.S. Application Data

(60) Provisional application No. 63/003,437, filed on Apr. 1, 2020.

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2320/041* (2013.01); *G09G 2330/021* (2013.01); *G09G 2330/045* (2013.01); *G09G 2370/00* (2013.01)

(58) Field of Classification Search
CPC ..... H01L 21/67248; G09G 2300/0408; G09G 3/3266; G09G 2320/041
See application file for complete search history.

(56) References Cited

U.S. PATENT DOCUMENTS

2012/0212473 A1* 8/2012 Hasegawa ..... G09G 3/3233 345/211

* cited by examiner

*Primary Examiner* — Gerald Johnson
(74) *Attorney, Agent, or Firm* — Rosenberg, Klein & Lee

(57) ABSTRACT

A display device and a driving device thereof is disclosed. The driving device is coupled to a display panel. The driving device includes at least one first driver integrated circuit (IC) and at least one second driver integrated circuit (IC). The first driver integrated circuit is coupled to the display panel. The first driver integrated circuit drives the display panel and detects a first working temperature. The second driver integrated circuit is coupled to the display panel and the first driver IC. The second driver integrated circuit drives the display panel. The first driver IC stops driving the display panel and communicates with the second driver IC to stop driving the display panel when the first working temperature is substantially higher than a first given temperature.

20 Claims, 14 Drawing Sheets

2

2

DISPLAY DEVICE AND DRIVING DEVICE THEREOF

This application claims priority for U.S. provisional patent application No. 63/003,437 filed on 1 Apr. 2020, the content of which is incorporated by reference in its entirely.

BACKGROUND OF THE INVENTION

Field of the Invention

The invention relates to the display technology, particularly to a display device and a driving device thereof.

Description of the Related Art

In high-resolution and large-size panel applications, common problems with high power consumption and overheating need to be overcome. In order to improve and avoid the instability of burnout and safety issues caused by overheating problems, the over-temperature protection (OTP) mechanism is used. However, the conventional OTP mechanism is only implemented in a single component, such as a driver integrated circuit (IC) or a power management integrated circuit (PMIC). The OTP mechanism implemented in a single component protects a part of the panel system rather than the whole panel system. Currently, the other components of the system still cause other undesirable problems.

FIG. 1 is a schematic diagram illustrating a conventional source driver including a temperature sensor. As illustrated in FIG. 1, a source driver 10 is coupled to a display panel 12. The source driver 10 drives the display panel 12. The source driver 10 includes a core circuit 101, a temperature sensor 102, and an electrical switch 103. The position of the temperature sensor 102 corresponds to that of the core circuit 101. The core circuit 101 and the temperature sensor 102 are coupled to the electrical switch 103. The core circuit 101 is coupled to the display panel 12. In a normal operation mode, the electrical switch 103 is turned on and the core circuit 101 receives power VDDA through the electrical switch 103 in order to drive the display panel 12. The temperature sensor 102 detects the working temperature of the core circuit 101. The temperature sensor 102 turns off the electrical switch 103 to stop driving the display panel 12 when the working temperature of the core circuit 101 is substantially higher than a given temperature. However, the other components coupled to the display panel 12, such as gate integrated circuits (ICs), may still drive the display panel 12 to cause undesirable problems.

SUMMARY OF THE INVENTION

The invention provides a display device and a driving device thereof, which decrease temperature and avoid display problems to achieve complete protection and stability of the overall display device. The display device and the driving device even synchronously adjust and optimize the functionality in order to greatly improve application of the display device.

In an embodiment of the invention, a display device is provided. The display device includes a display panel, at least one first driver integrated circuit (IC), and at least one second driver integrated circuit (IC). The first driver IC is coupled to the display panel and configured to drive the display panel and detect a first working temperature. The second driver IC is coupled to the display panel and the first driver IC and configured to drive the display panel. The first driver IC stops driving the display panel and communicates with the second driver IC to stop driving the display panel when the first working temperature is substantially higher than a first given temperature.

In an embodiment of the invention, a driving device is provided. The driving device includes at least one first driver integrated circuit (IC) and at least one second driver integrated circuit (IC). The first driver IC is coupled to a display panel and configured to drive the display panel and detect a first working temperature. The second driver IC is coupled to the display panel and the first driver IC and configured to drive the display panel. The first driver IC stops driving the display panel and communicates with the second driver IC to stop driving the display panel when the first working temperature is substantially higher than a first given temperature.

To sum up, the first driver IC stops driving the display panel and synchronously communicates with the second driver IC to stop driving a display panel when the first driver IC determines whether its working temperature is substantially higher than a given temperature. The display device and the driving device decrease temperature and avoid display problems to achieve complete protection and stability of the overall display device. The display device and the driving device even synchronously adjust and optimize the functionality in order to greatly improve application of the display device.

Below, the embodiments are described in detail in cooperation with the drawings to make easily understood the technical contents, characteristics and accomplishments of the invention.

DETAILED DESCRIPTION OF THE INVENTION

Figure 1:
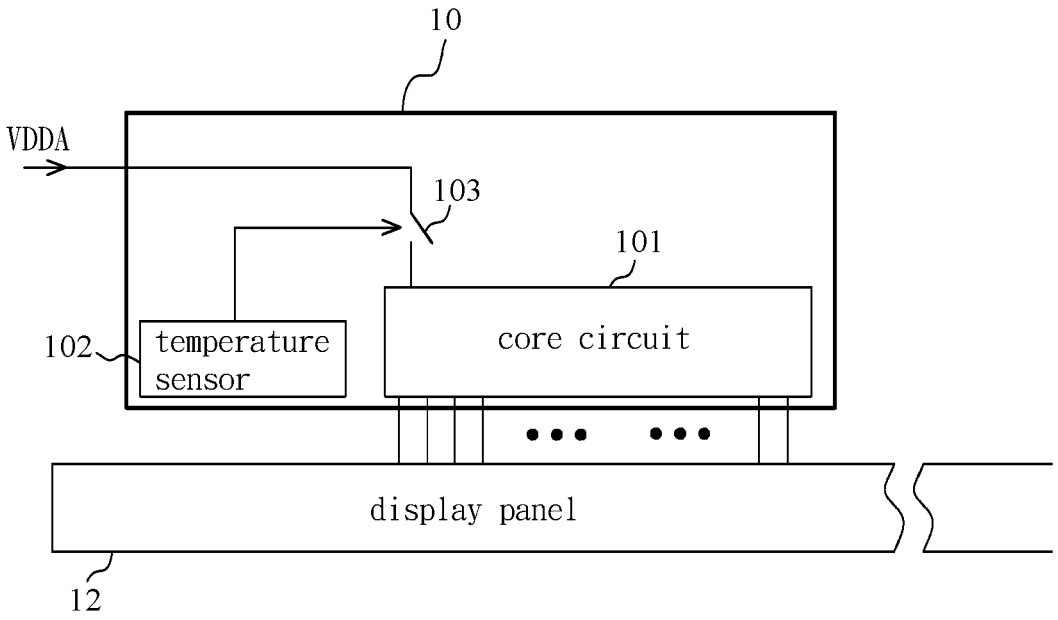
Fig. 1(prior art)
FIG. 1 is a diagram schematically illustrating a conventional source driver including a temperature sensor.

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Unless otherwise specified, some conditional sentences or words, such as "can", "could", "might", or "may", usually attempt to express that the embodiment in the invention has, but it can also be interpreted as a feature, element, or step that may not be needed. In other embodiments, these features, elements, or steps may not be required.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The phrases "be coupled to," "couples to," and "coupling to" are intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In the following description, a display device and a driving device thereof will be provided. In the driving device, at least one first driver integrated circuit (IC) stops driving a display panel and synchronously communicates with at least one second driver integrated circuit (IC) to stop driving the display panel when the first driver IC detects overheating events, thereby achieving complete protection. The driving devices provided below may also be applied to other circuit configurations.

Figure 2:
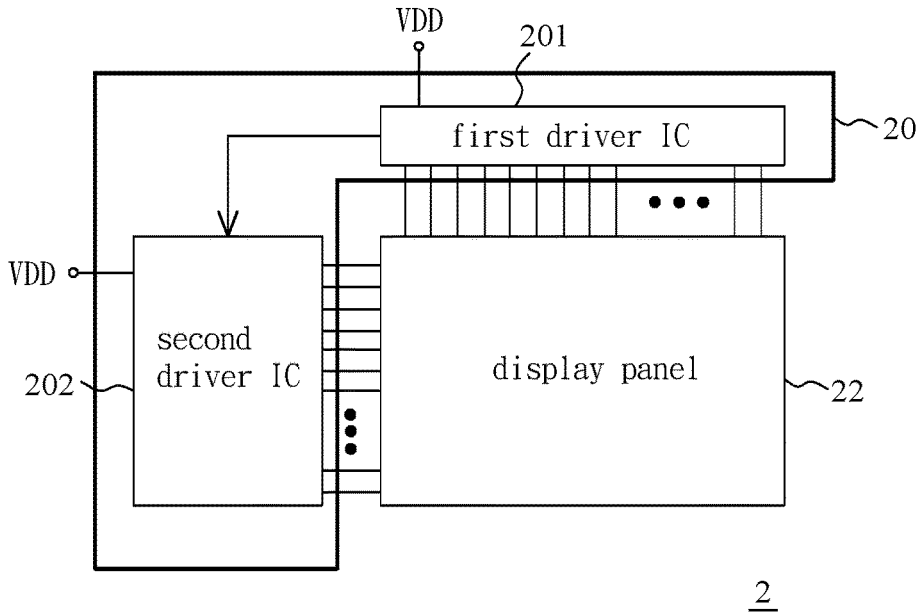
FIG. 2 is a diagram schematically illustrating a display device according to a first embodiment of the invention.

FIG. 2 is a diagram schematically illustrating a display device according to a first embodiment of the invention. The first embodiment is a unidirectional transmission architecture. Referring to FIG. 2, a display device 2 includes a driving device 20 and a display panel 22. The driving device 20 is coupled to the display panel 22. The driving device 20 includes at least one first driver IC 201 and at least one second driver IC 202. In the first embodiment, there are one or more first driver ICs 201 and one or more second driver ICs 202. For clarity and convenience, the first embodiment exemplifies one first driver IC 201 and one second driver IC 202. The first driver IC 201 and the second driver IC 202 may be various driver ICs. For example, the first driver IC 201 is a source driver IC and the second driver IC 202 is a gate driver IC. Alternatively, the first driver IC 201 is a gate driver IC and the second driver IC 202 is a source driver IC. The outputs of the first driver IC 201 and the second driver IC 202 are coupled to the display panel 22. In addition, the first driver IC 201 and the second driver IC 202 are coupled to each other. The first driver IC 201 and the second driver IC 202 are coupled to an external power terminal. The first driver IC 201 and the second driver IC 202 receive the external power VDD of the external power terminal to operate. In the first embodiment, the first driver IC 201 unidirectionally communicates with the second driver IC 202.

Figure 3:
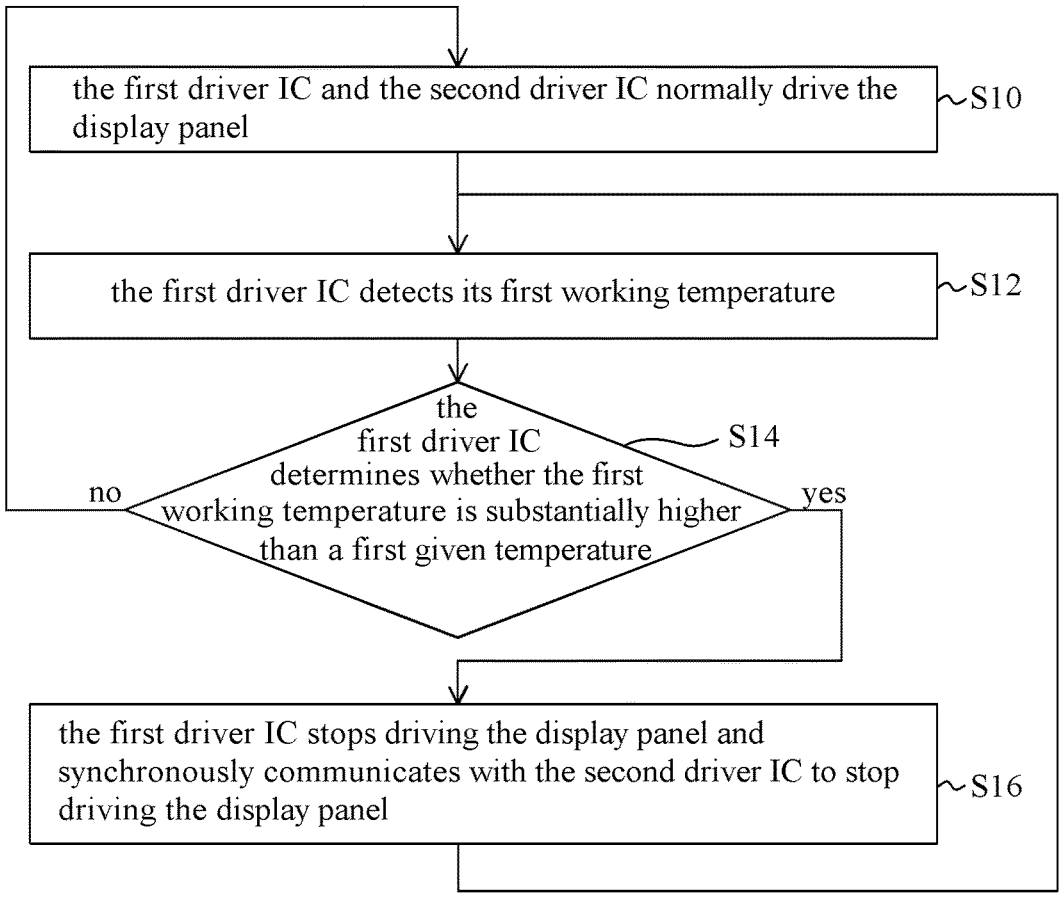
FIG. 3 is a flowchart of the operation of the display device according to the first embodiment of the invention.

FIG. 3 is a flowchart of the operation of the display device according to the first embodiment of the invention. Referring to FIG. 2 and FIG. 3, the operation of the display device according to the first embodiment of the invention is introduced as follows. In Step S10, the first driver IC 201 and the second driver IC 202 normally drive the display panel 22. In Step S12, the first driver IC 201 detects its first working temperature. In Step S14, the first driver IC 201 determines whether the first working temperature is substantially higher than a first given temperature. The first given temperature may have a fixed temperature value or a temperature range. The first given temperature may be preset by an external device or built in the first driver IC 201 in advance. The invention should not be limited to the way to set the first given temperature. If the answer is yes, the process proceeds to Step S16. If the answer is no, the process returns to Step S10. In Step S16, the first driver IC 201 stops driving the display panel 22 and synchronously communicates with the second driver IC 202 to stop driving the display panel 22, thereby decreasing the working temperature of the first driver IC 201 and the second driver IC 202. As a result, the first embodiment achieves complete protection and avoids display problems with the display device 2 in order to effectively improve stability of the display device 2. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. After Step S16, the process proceeds to Step S12. After a period of time, the first working temperature of the first driver IC 201 is decreased. In Step S14, the first driver IC 201 determines whether the first working temperature is substantially higher than the first given temperature once again. If the answer is no, the process returns to Step S10 such that the first driver IC 201 communicates and cooperates with the second driver IC 202 to normally drive the display panel 22.

Figure 4:
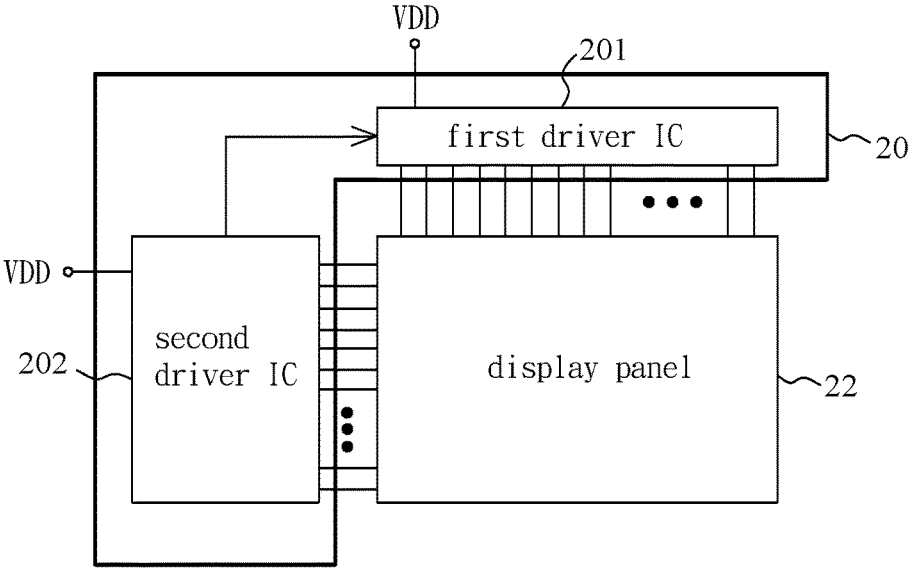
FIG. 4 is a diagram schematically illustrating a display device according to a second embodiment of the invention.

FIG. 4 is a diagram schematically illustrating a display device according to a second embodiment of the invention. The second embodiment is also a unidirectional transmission architecture. The circuit configuration of the second embodiment is the same to that of the first embodiment so will not be reiterated. In the second embodiment, the second driver IC 202 unidirectionally communicates with the first driver IC 201.

Figure 5:
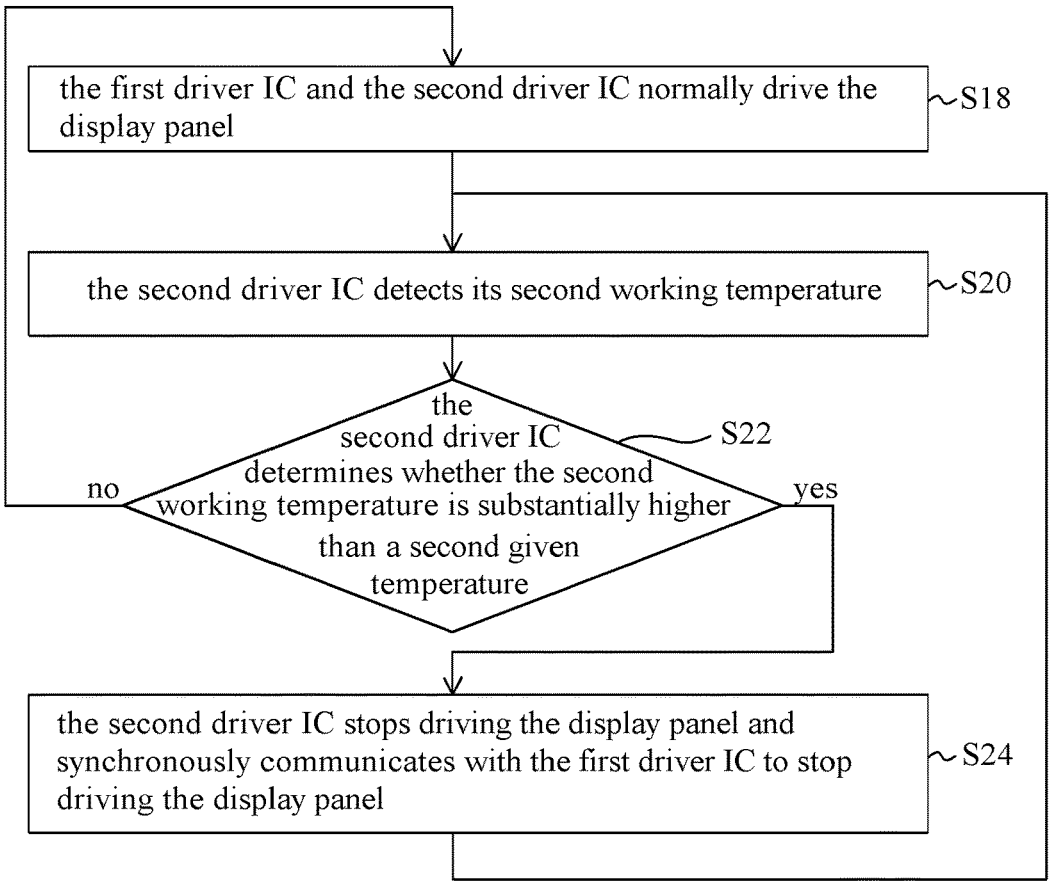
FIG. 5 is a flowchart of the operation of the display device according to the second embodiment of the invention.

FIG. 5 is a flowchart of the operation of the display device according to the second embodiment of the invention. Referring to FIG. 4 and FIG. 5, the operation of the display device according to the second embodiment of the invention is introduced as follows. In Step S18, the first driver IC 201 and the second driver IC 202 normally drive the display panel 22. In Step S20, the second driver IC 202 detects its second working temperature. In Step S22, the second driver IC 202 determines whether the second working temperature is substantially higher than a second given temperature. The first given temperature and the second given temperature are the same or different. The second given temperature may have a fixed temperature value or a temperature range. The second given temperature may be preset by an external device or built in the second driver IC 202 in advance. The invention should not be limited to the way to set the second given temperature. If the answer is yes, the process proceeds to Step S24. If the answer is no, the process returns to Step S18. In Step S24, the second driver IC 202 stops driving the display panel 22 and synchronously communicates with the first driver IC 201 to stop driving the display panel 22, thereby decreasing the working temperature of the first driver IC 201 and the second driver IC 202. As a result, the second embodiment achieves complete protection and avoids display problems with the display device 2 in order to effectively improve stability of the display device 2. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. After Step S24, the process proceeds to Step S20. After a period of time, the second working temperature of the second driver IC 202 is decreased. In Step S22, the second driver IC 202 determines whether the second working temperature is substantially higher than the second given temperature once again. If the answer is no, the process returns to Step S18 such that the second driver IC 202 communicates and cooperates with the first driver IC 201 to normally drive the display panel 22.

Figure 6:
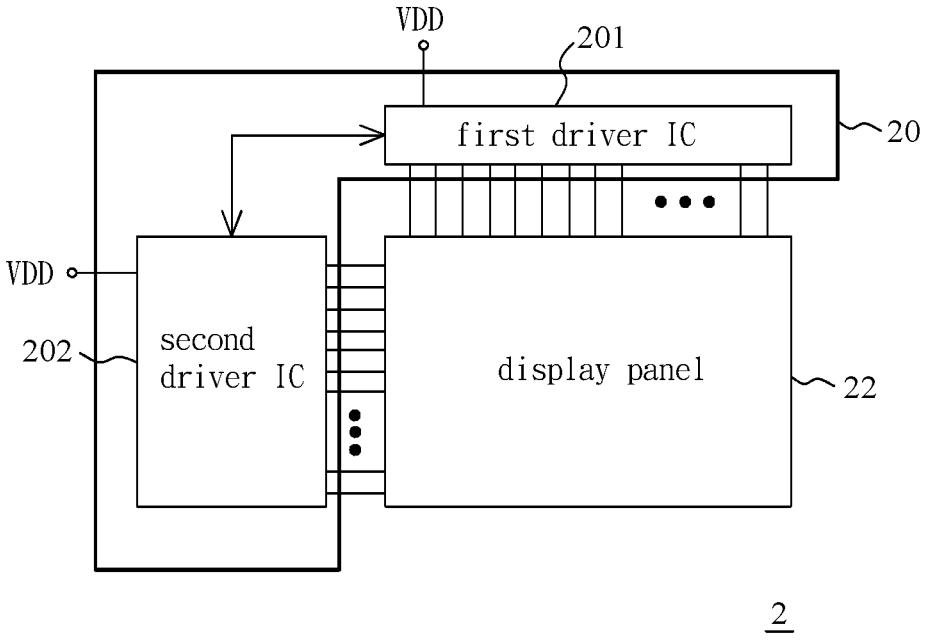
FIG. 6 is a diagram schematically illustrating a display device according to a third embodiment of the invention.

FIG. 6 is a diagram schematically illustrating a display device according to a third embodiment of the invention. The circuit configuration of the third embodiment is the same to that of the first embodiment so will not be reiterated. The third embodiment can perform one of flowcharts of FIG. 3 and FIG. 5. Alternatively, the third embodiment is a bidirectional transmission architecture. The third embodiment can simultaneously perform flowcharts of FIG. 3 and FIG. 5, thereby greatly increasing the error detection capability and stability of the display device 2.

Figure 7:
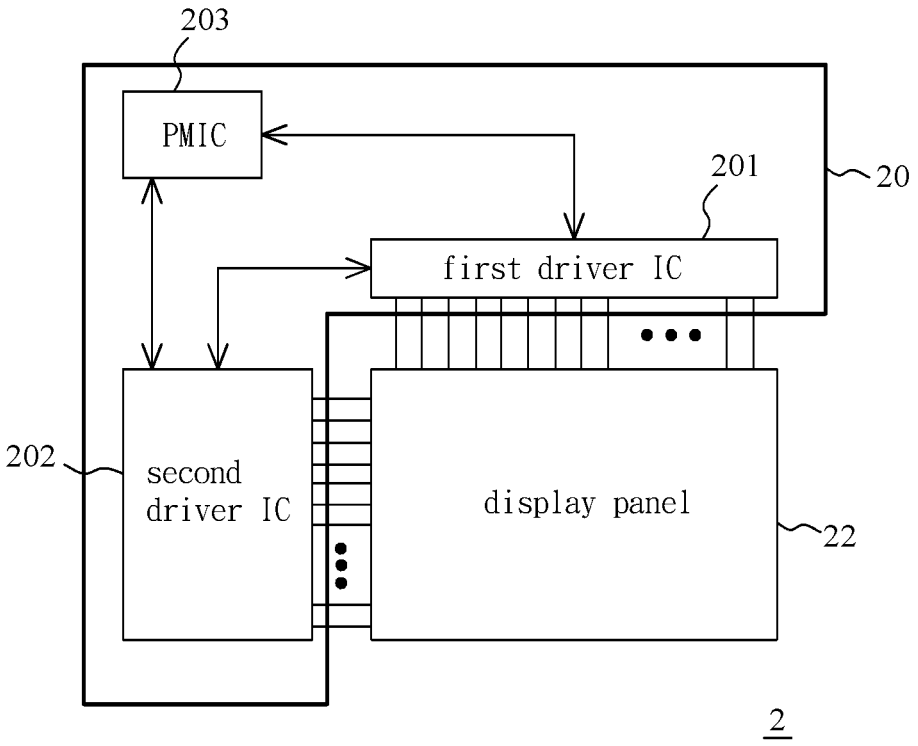
FIG. 7 is a diagram schematically illustrating a display device according to a fourth embodiment of the invention.

FIG. 7 is a diagram schematically illustrating a display device according to a fourth embodiment of the invention. Referring to FIG. 7, the fourth embodiment is introduced as follows. Compared with the first embodiment, the driving device 20 of the fourth embodiment may further include a power management integrated circuit (PMIC) 203. The PMIC 203 may be coupled to the first driver IC 201, the second driver IC 202, or both. The PMIC 203 replaces the external power terminal of the first embodiment.

Figure 8:
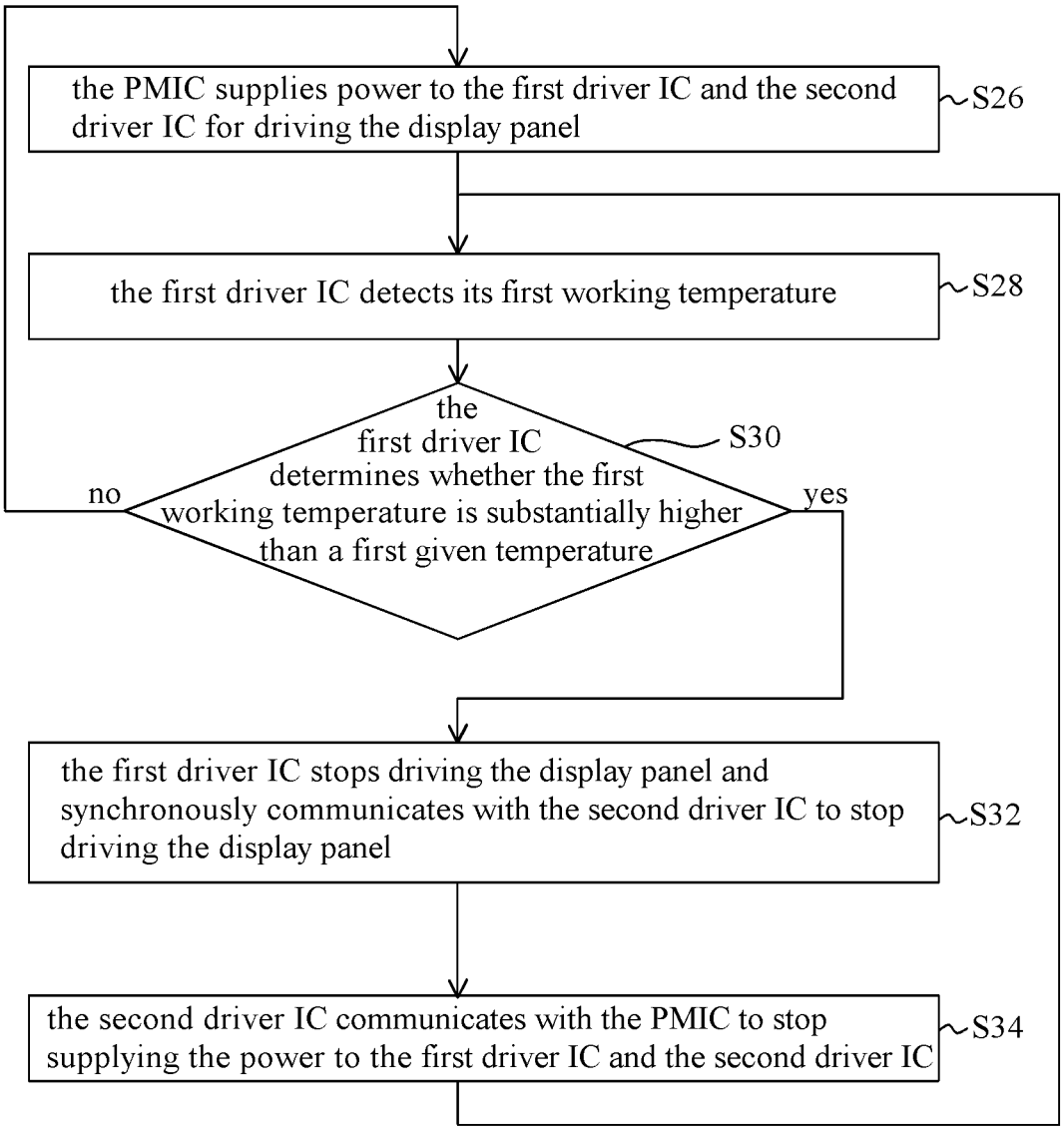
FIG. 8 is a flowchart of an operation of the display device according to the fourth embodiment of the invention.

FIG. 8 is a flowchart of an operation of the display device according to the fourth embodiment of the invention. Referring to FIG. 7 and FIG. 8, an operation of the display device according to the fourth embodiment of the invention is introduced as follows. In Step S26, the PMIC 203 supplies power to the first driver IC 201 and the second driver IC 202 for driving the display panel 22. In Step S28, the first driver IC 201 detects its first working temperature. In Step S30, the first driver IC 201 determines whether the first working temperature is substantially higher than a first given temperature. The first given temperature may have a fixed temperature value or a temperature range. The first given temperature may be preset by an external device or built in the first driver IC 201 in advance. The invention should not be limited to the way to set the first given temperature. If the answer is yes, the process proceeds to Step S32. If the answer is no, the process returns to Step S26. In Step S32, the first driver IC 201 stops driving the display panel 22 and synchronously communicates with the second driver IC 202 to stop driving the display panel 22, thereby decreasing the working temperature of the first driver IC 201 and the second driver IC 202. As a result, the fourth embodiment achieves complete protection and avoids display problems with the display device 2. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. In Step S34, the second driver IC 202 communicates with the PMIC 203 to stop supplying the power to the first driver IC 201 and the second driver IC 202, thereby greatly reducing power consumption, improving the flexibility of the display application, and stabilizing the display device 2. After Step S34, the process proceeds to Step S28. After a period of time, the first working temperature of the first driver IC 201 is decreased. In Step S30, the first driver IC 201 determines whether the first working temperature is substantially higher than the first given temperature once again. If the answer is no, the process returns to Step S26 such that the first driver IC 201 communicates with the PMIC 203 to supply power to the first driver IC 201 and the second driver IC 202 for driving the display panel 22.

Figure 9:
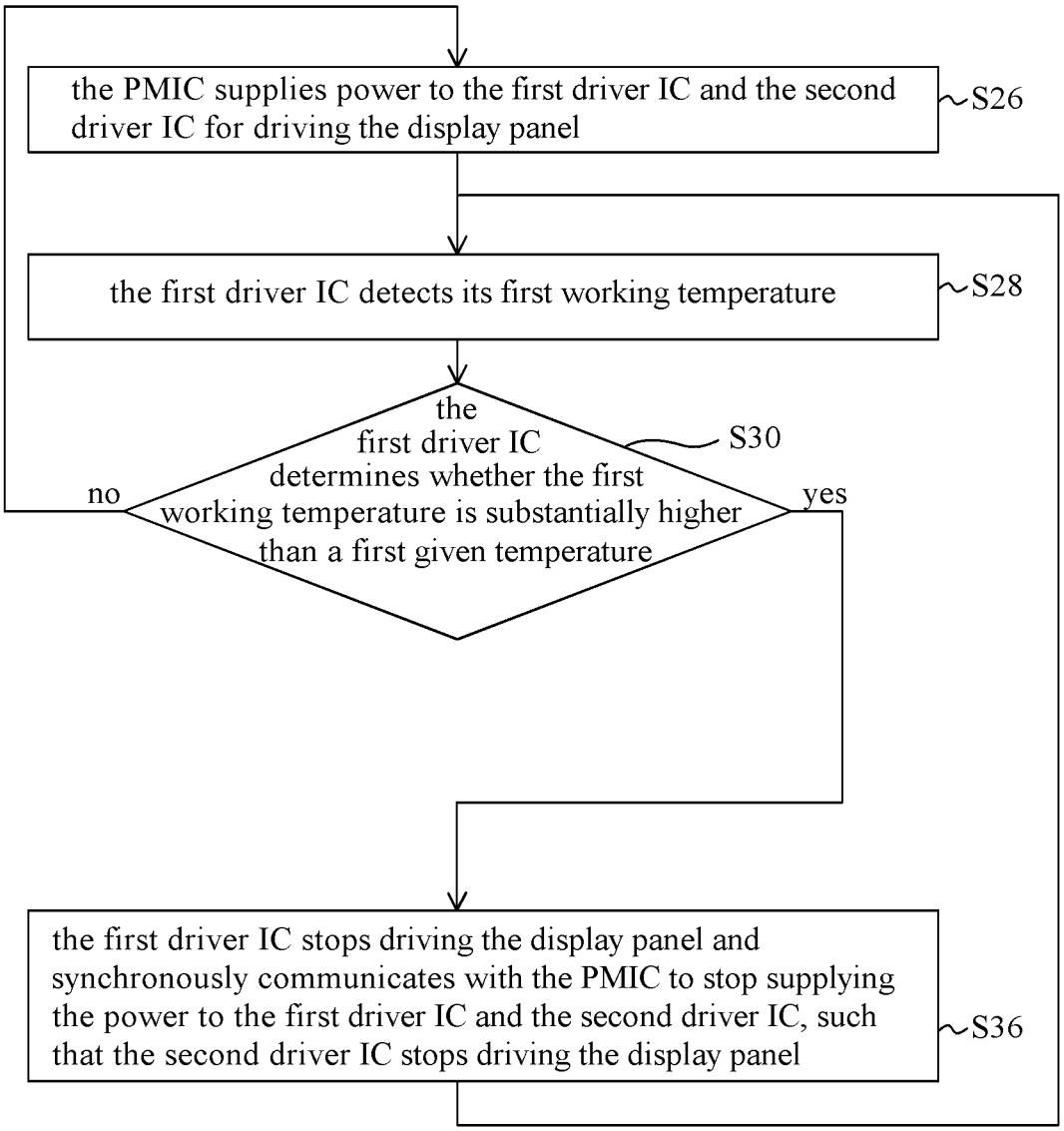
FIG. 9 is a flowchart of another operation of the display device according to the fourth embodiment of the invention.

FIG. 9 is a flowchart of another operation of the display device according to the fourth embodiment of the invention. Referring to FIG. 7 and FIG. 9, another operation of the display device according to the fourth embodiment of the invention is introduced as follows. Steps S26-S30 have been described previously so will not be reiterated. If the first driver IC 201 determines whether the first working temperature is substantially higher than the first given temperature, the process proceeds to Step S36. In Step S36, the first driver IC 201 stops driving the display panel 22 and synchronously communicates with the PMIC 203 to stop supplying the power to the first driver IC 201 and the second driver IC 202, such that the second driver IC 202 stops driving the display panel 22, thereby decreasing the working temperature of the first driver IC 201 and the second driver IC 202. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. As a result, the fourth embodiment achieves complete protection, avoids display problems with the display device 2, greatly reduces power consumption, and stabilizes the display device 2. After Step S36, the process proceeds to Step S28. After a period of time, the first working temperature of the first driver IC 201 is decreased. In Step S30, the first driver IC 201 determines whether the first working temperature is substantially higher than the first given temperature once again. If the answer is no, the process returns to Step S26 such that the first driver IC 201 communicates with the PMIC 203 to supply power to the first driver IC 201 and the second driver IC 202 for driving the display panel 22.

Figure 10:
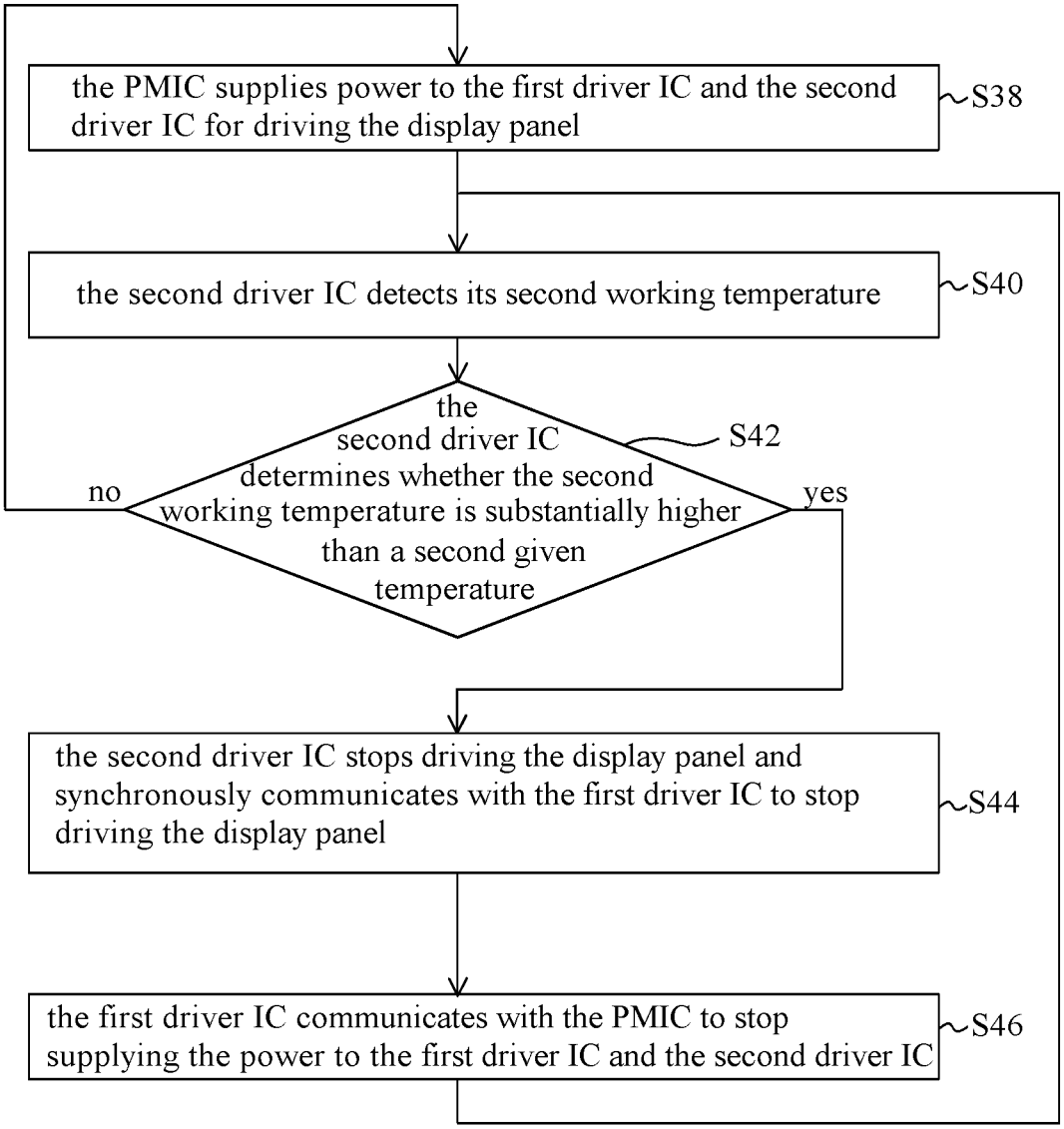
FIG. 10 is a flowchart of further operation of the display device according to the fourth embodiment of the invention.

FIG. 10 is a flowchart of further operation of the display device according to the fourth embodiment of the invention. Referring to FIG. 7 and FIG. 10, further operation of the display device according to the fourth embodiment of the invention is introduced as follows. In Step S38, the PMIC 203 supplies power to the first driver IC 201 and the second driver IC 202 for driving the display panel 22. In Step S40, the second driver IC 202 detects its second working temperature. In Step S42, the second driver IC 202 determines whether the second working temperature is substantially higher than a second given temperature. The second given temperature may have a fixed temperature value or a temperature range. The second given temperature may be preset by an external device or built in the second driver IC 202 in advance. The invention should not be limited to the way to set the second given temperature. If the answer is yes, the process proceeds to Step S44. If the answer is no, the process returns to Step S38. In Step S44, the second driver IC 202 stops driving the display panel 22 and synchronously communicates with the first driver IC 201 to stop driving the display panel 22, thereby decreasing the working temperature of the first driver IC 201 and the second driver IC 202. As a result, the fourth embodiment achieves complete protection and avoids display problems with the display device 2. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. In Step S46, the first driver IC 201 communicates with the PMIC 203 to stop supplying the power to the first driver IC 201 and the second driver IC 202, thereby greatly reducing power consumption, improving the flexibility of the display application, and stabilizing the display device 2. After Step S46, the process proceeds to Step S40. After a period of time, the second working temperature of the second driver IC 202 is decreased. In Step S42, the second driver IC 202 determines whether the second working temperature is substantially higher than the second given temperature once again. If the answer is no, the process returns to Step S38 such that the second driver IC 202 communicates with the PMIC 203 to supply power to the first driver IC 201 and the second driver IC 202 for driving the display panel 22.

Figure 11:
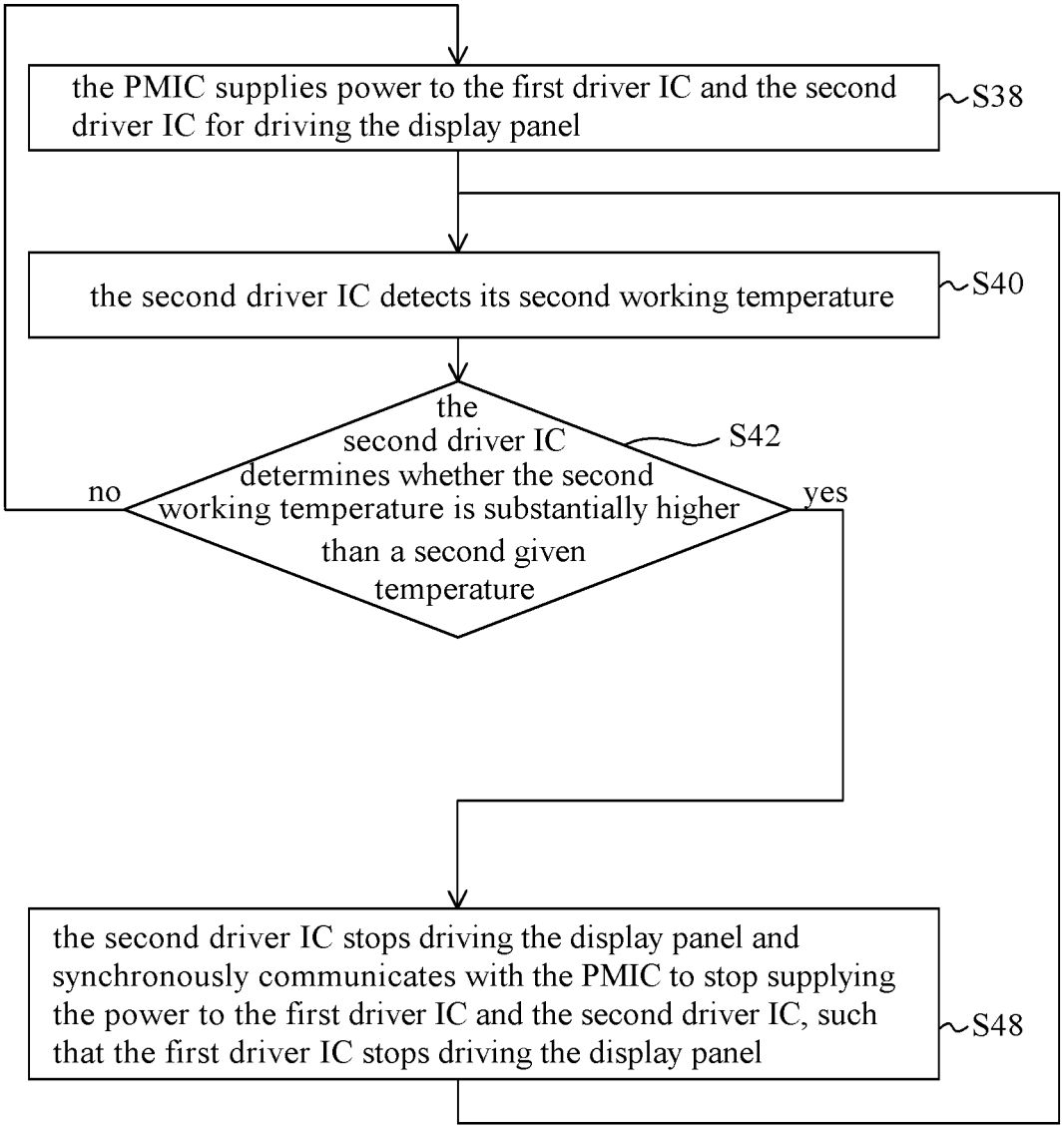
FIG. 11 is a flowchart of yet another operation of the display device according to the fourth embodiment of the invention.

FIG. 11 is a flowchart of yet another operation of the display device according to the fourth embodiment of the invention. Referring to FIG. 7 and FIG. 11, yet another operation of a display device according to the fourth embodiment of the invention is introduced as follows. Steps S38-S42 have been described previously so will not be reiterated. If the second driver IC 202 determines whether the second working temperature is substantially higher than the second given temperature, the process proceeds to Step S48. In Step S48, the second driver IC 202 stops driving the display panel 22 and synchronously communicates with the PMIC 203 to stop supplying the power to the first driver IC 201 and the second driver IC 202, such that the first driver IC 201 stops driving the display panel 22, thereby decreasing the working temperature of the first driver IC 201 and the second driver IC 202. In some embodiments of the invention, the first driver IC 201 and the second driver IC 202 stop driving the display panel 22 due to a fact that the outputs of the first driver IC 201 and the second driver IC 202 are in a high-impedance state, but the invention is not limited thereto. As a result, the fourth embodiment achieves complete protection, avoids display problems with the display device 2, greatly reduces power consumption, and stabilizes the display device 2. After Step S48, the process proceeds to Step S40. After a period of time, the second working temperature of the second driver IC 202 is decreased. In Step S42, the second driver IC 202 determines whether the second working temperature is substantially higher than the second given temperature once again. If the answer is no, the process returns to Step S38 such that the second driver IC 202 communicates with the PMIC 203 to supply power to the first driver IC 201 and the second driver IC 202 for driving the display panel 22.

Figure 12:
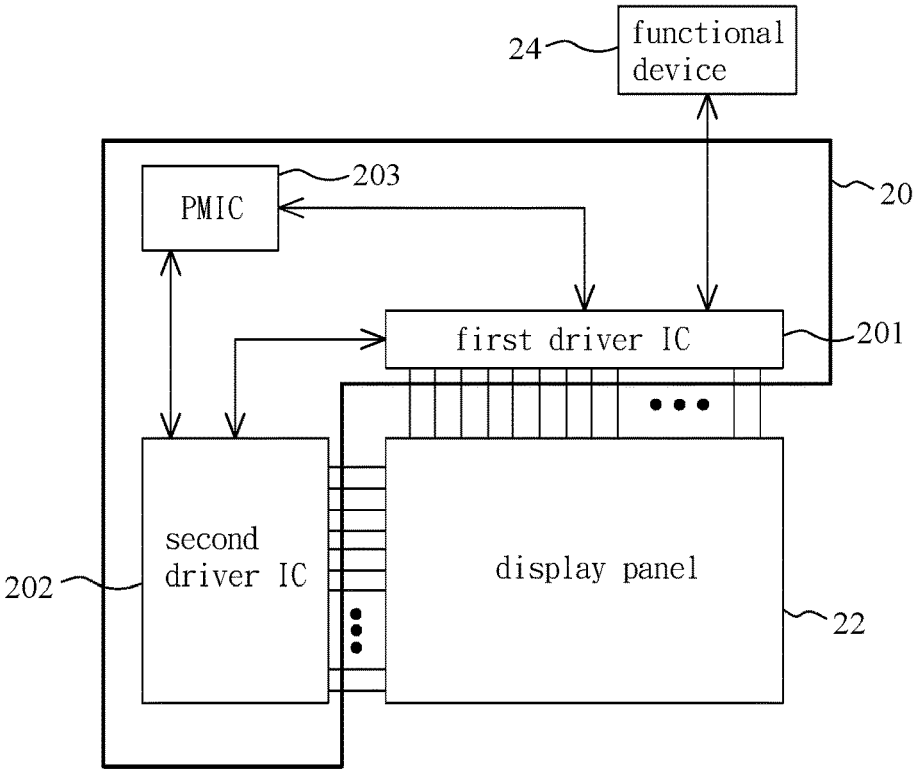
FIG. 12 is a diagram schematically illustrating a display device according to a fifth embodiment of the invention.

FIG. 12 is a diagram schematically illustrating a display device according to a fifth embodiment of the invention. Referring to FIG. 12, the fifth embodiment is introduced as follows. Compared with the fourth embodiment, the fifth embodiment may further include at least one functional device 24. In other words, one or more functional devices 24 are used in the fifth embodiment. For clarity and convenience, the fifth embodiment exemplifies one functional device 24. The functional device 24 includes, but not limited to, a timing controller, a light-emitting diode (LED) driver, active elements, or passive elements. The functional device 24 is coupled to the first driver IC 201. The first driver IC 201 communicates with the functional device 24 to perform a corresponding function when the first driver IC 201 determine that the first working temperature is substantially higher than the first given temperature. For example, the functional device 24 implemented with a LED driver may drive LEDs to generate a warning signal at high frequency when the first driver IC 201 determine that the first working temperature is substantially higher than the first given temperature. In addition, the PMIC 203 may be replaced with the external power terminal illustrated in FIG. 2.

Figure 13:
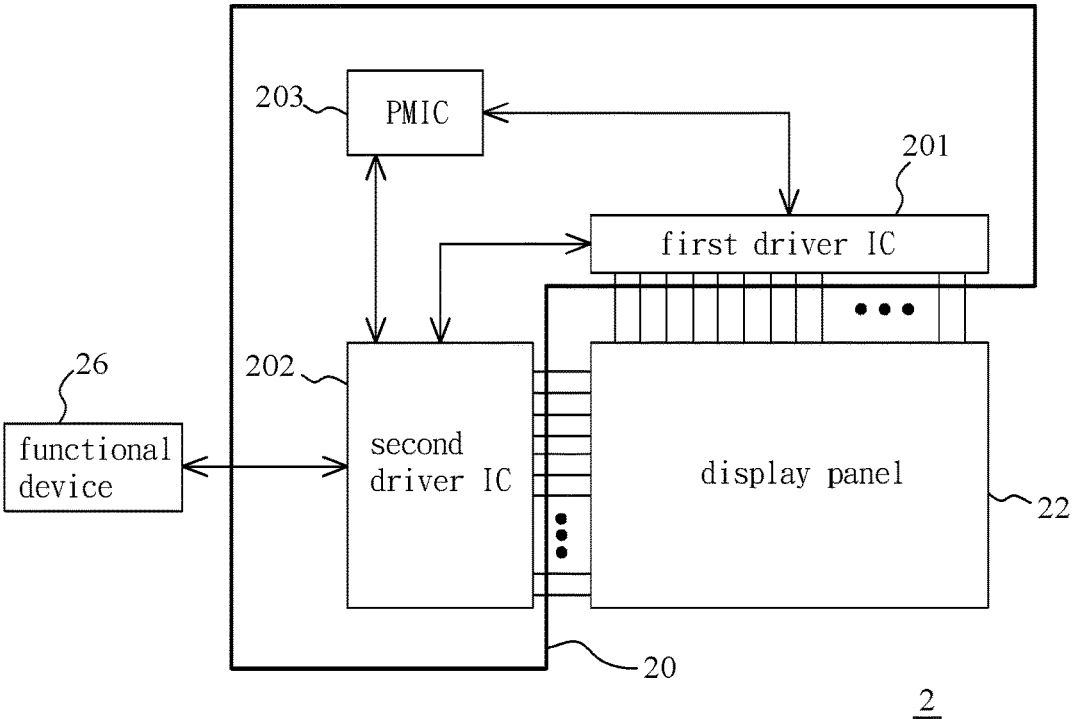
FIG. 13 is a diagram schematically illustrating a display device according to a sixth embodiment of the invention.

FIG. 13 is a diagram schematically illustrating a display device according to a sixth embodiment of the invention. Referring to FIG. 13, the sixth embodiment is introduced as follows. Compared with the fourth embodiment, the sixth embodiment may further include at least one functional device 26. In other words, one or more functional devices 26 are used in the sixth embodiment. For clarity and convenience, the sixth embodiment exemplifies one functional device 26. The functional device 26 includes, but not limited to, a timing controller, a light-emitting diode (LED) driver, active elements, or passive elements. The functional device 26 is coupled to the second driver IC 202. The second driver IC 202 communicates with the functional device 26 to perform a corresponding function when the second driver IC 202 determine that the second working temperature is substantially higher than the second given temperature. For example, the functional device 26 implemented with a LED driver may drive LEDs to generate a warning signal at high frequency when the second driver IC 202 determine that the second working temperature is substantially higher than the second given temperature. In addition, the PMIC 203 may be replaced with the external power terminal illustrated in FIG. 2.

Figure 14:
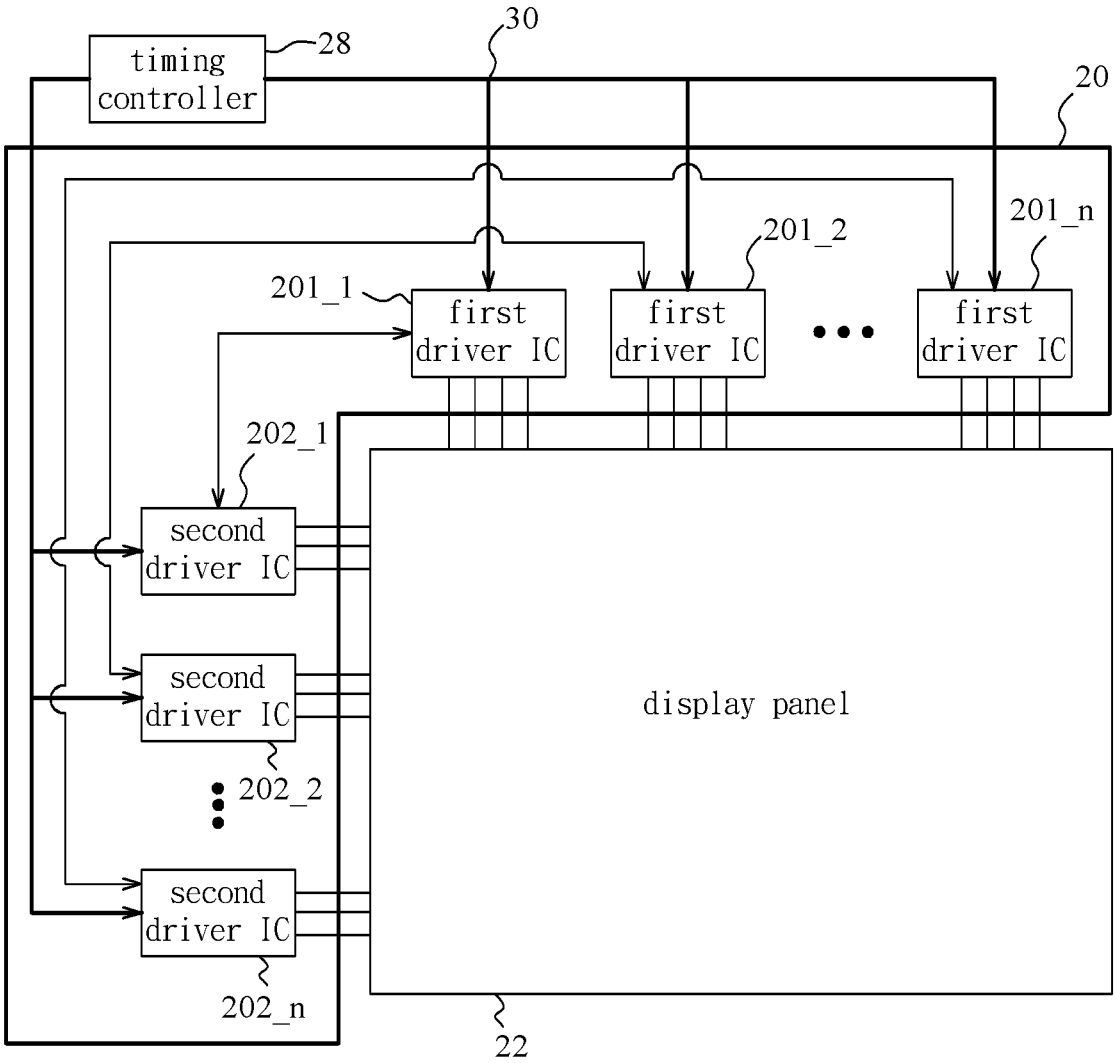
FIG. 14 is a diagram schematically illustrating a display device according to a seventh embodiment of the invention.

FIG. 14 is a diagram schematically illustrating a display device according to a seventh embodiment of the invention. Referring to FIG. 14, the seventh embodiment is introduced as follows. Compared with the fourth embodiment, the seventh embodiment omits the PMIC 203 for clarity and convenience. Compared with the fourth embodiment, the seventh embodiment may use a plurality of first driver ICs **201_1~201_*n* and a plurality of second driver ICs 202_1~202_*n*. The first driver ICs 201_1~201_*n* may be coupled to the external power terminal illustrated in FIG. 2 or the PMIC 203 illustrated in FIG. 7. The first driver ICs 201_1~201_*n* may receive the power from the external power terminal or the PMIC 203 illustrated in FIG. 7 to operate. Similarly, the second driver ICs 202_1~202_*n* may be coupled to the external power terminal illustrated in FIG. 2 or the PMIC 203 illustrated in FIG. 7. The second driver ICs 202_1~202_n may receive the power from the external power terminal or the PMIC 203 illustrated in FIG. 7 to operate. The first driver ICs 201_1~201_n and the second driver ICs 202_1~202_n are coupled to each other. For example, the first driver ICs 201_1~201_n are respectively coupled to the second driver ICs 202_1~202_n, but the invention is not limited thereto. The first driver ICs 201_1~201_n and the second driver ICs 202_1~202_n are coupled to a functional device implemented with a timing controller 28 through a multi-drop bus 30**.

Suppose that the first driver ICs 201_1, the first driver IC 201_n, the second driver IC 202_1, and the second driver IC 202_n consume more power. For example, the first driver IC 201_1 communicates with the timing controller 28 to adjust the timing signal transmitted to the first driver IC 201_1 and the first driver IC 201_n and save power consumption through the multi-drop bus 30 when the first driver IC 201_1 determines that the first working temperature of the first driver IC 201_1 is substantially higher than the first given temperature. Similarly, the second driver IC 202_1 communicates with the timing controller 28 to adjust the timing signal transmitted to the second driver IC 202_1 and the second driver IC 202_n and save power consumption through the multi-drop bus 30 when the second driver IC 202_1 determines that the second working temperature of the second driver IC 202_1 is substantially higher than the second given temperature. The embodiments of FIG. 12, FIG. 13, and FIG. 14 can synchronously adjust and optimize the functionality in order to greatly improve application, stability, and versatility of the display device 2 when detecting overheating events. Thus, system matching problems and solutions can be considered simultaneously.

Figure 15:
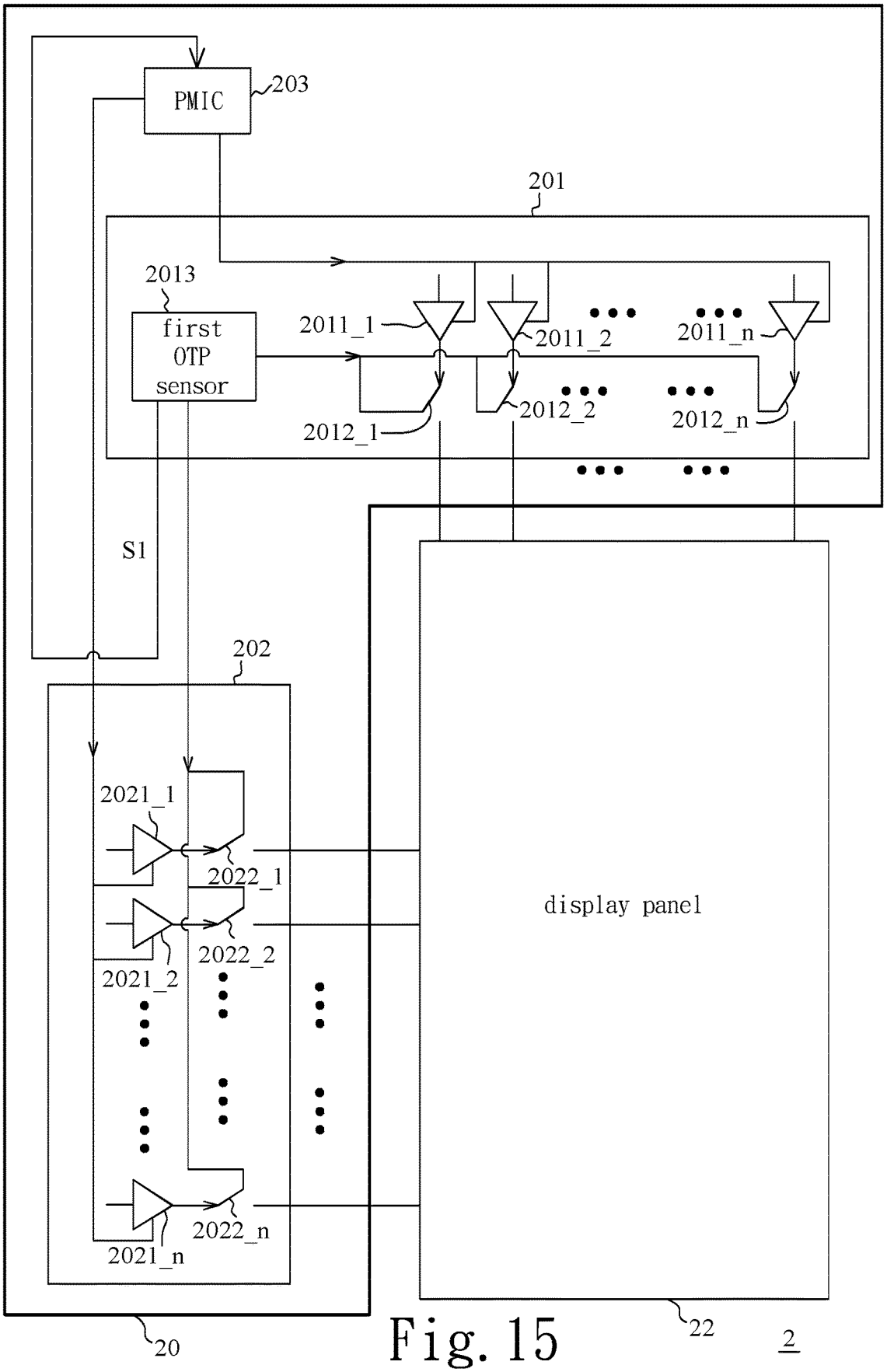
FIG. 15 is a diagram schematically illustrating a display device according to an eighth embodiment of the invention.

FIG. 15 is a diagram schematically illustrating a display device according to an eighth embodiment of the invention. Referring to FIG. 15, the eighth embodiment is introduced as follows. Compared with the fourth embodiment, the first driver IC 201 of the eighth embodiment may include a plurality of first voltage generators 2011_1~2011_n, a plurality of first electrical switches 2012_1~2012_n, and a first over-temperature protection (OTP) sensor 2013. The first voltage generators 2011_1~2011_n include, but not limited to, operational amplifiers. The first electrical switches 2012_1~2012_n include, but not limited to, NMOSFETs, PMOSFETs, or a combination of these. The first over-temperature protection sensor 2013 may be implemented with a temperature sensor, but the invention is not limited thereto. The first voltage generators 2011_1~2011_n have the first working temperature.

The first voltage generators 2011_1~2011_n are coupled to the PMIC 203. The inputs of the first electrical switches 2012_1~2012_n are respectively coupled to the outputs of the first voltage generators 2011_1~2011_n. The outputs of the first electrical switches 2012_1~2012_n are coupled to the display panel 22. The outputs of the first electrical switches 2012_1~2012_n are used as the outputs of the first driver IC 201. The position of the first over-temperature protection sensor 2013 corresponds to the positions of all first voltage generators 2011_1~2011_n. The first OTP sensor 2013 is coupled to the PMIC 203 and the control terminals of the first electrical switches 2012_1~2012_n.

The second driver IC 202 may include a plurality of second voltage generators 2021_1~2021_n and a plurality of second electrical switches 2022_1~2022_n. The second voltage generators 2021_1~2021_n include, but not limited to, operational amplifiers. The second electrical switches 2022_1~2022_n include, but not limited to, NMOSFETs, PMOSFETs, or a combination of these.

The second voltage generators 2021_1~2021_n are coupled to the PMIC 203. The outputs of the second voltage generators 2021_1~2021_n are respectively coupled to the inputs of the second electrical switches 2022_1~2022_n. The outputs of the second electrical switches 2022_1~2022_n are coupled to the display panel 22. The outputs of the second electrical switches 2022_1~2022_n are used as the outputs of the second driver IC 202. The control terminals of the second electrical switches 2022_1~2022_n are coupled to the first OTP sensor 2013. In some embodiments of the invention, the PMIC 203 may be replaced with the external power terminal illustrated in FIG. 2.

In a normal operation mode, the first OTP sensor 2013 turns on the first electrical switches 2012_1~2012_n and the second electrical switches 2022_1~2022_n since the first OTP sensor 2013 determines that the first working temperature is not substantially higher than the first given temperature. The PMIC 203 supplies power to the first voltage generators 2011_1~2011_n and the second voltage generators 2021_1~2021_n, and the first voltage generators 2011_1~2011_n and the second voltage generators 2021_1~2021_n responsively drive the display panel 22 through the first electrical switches 2012_1~2012_n and the second electrical switches 2022_1~2022_n.

When the first OTP sensor 2013 determines that the first working temperature is substantially higher than the first given temperature, the first OTP sensor 2013 turns off the first electrical switches 2012_1~2012_n and the second electrical switches 2022_1~2022_n, such that the outputs of the first electrical switches 2012_1~2012_n and the second electrical switches 2022_1~2022_n are in a high-impedance state. In some embodiments of the invention, when the first OTP sensor 2013 determines that the first working temperature is substantially higher than the first given temperature, the first OTP sensor 2013 may generate and transmit a first over-temperature protection (OTP) signal S1 to the PMIC 203. The PMIC 203 stops supplying power to the first voltage generators 2011_1~2011_n and the second voltage generators 2021_1~2021_n in response to the first OTP signal S1, such that the outputs of the first electrical switches 2012_1~2012_n and the second electrical switches 2022_1~2022_n are in a high-impedance state. The architecture in FIG. 15 may be applied to the architecture in FIG. 2 or the other embodiments, but the invention is not limited to such the display device 2 in FIG. 15. If the display device 2 in FIG. 15 is applied to the display device 2 in FIG. 12, the first OTP sensor 2013 may be coupled to the functional device 24. The functional device 24 may be coupled to the inputs of the first voltage generators 2011_1~2011_n and the second electrical switches 2022_1~2022_n. The first OTP sensor 2013 may transmit the first OTP signal S1 to the functional device 24 to perform a corresponding function.

Figure 16:
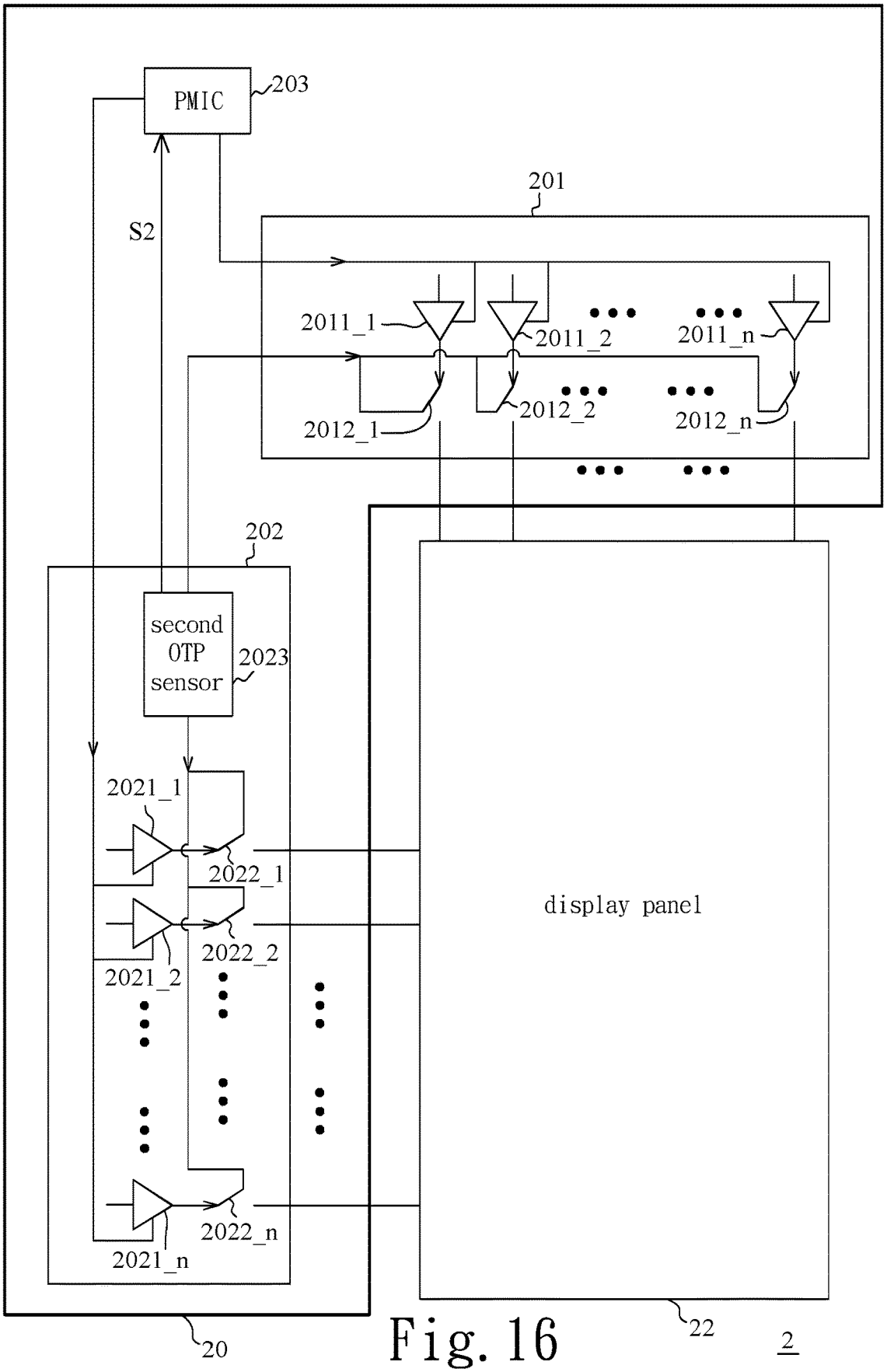
FIG. 16 is a diagram schematically illustrating a display device according to a ninth embodiment of the invention.

FIG. 16 is a diagram schematically illustrating a display device according to a ninth embodiment of the invention. Referring to FIG. 16, the ninth embodiment is introduced as follows. Compared with the fourth embodiment, the first driver IC 201 of the ninth embodiment may include a plurality of first voltage generators 2011_1~2011_n and a plurality of first electrical switches 2012_1~2012_n. The first voltage generators 2011_1~2011_n have the first working temperature.

The first voltage generators 2011_1~2011_n are coupled to the PMIC 203. The inputs of the first electrical switches 2012_1~2012_n are respectively coupled to the outputs of the first voltage generators 2011_1~2011_n. The outputs of the first electrical switches 2012_1~2012_n are coupled to the display panel 22. The outputs of the first electrical switches **2012_1~2012_*n* are used as the outputs of the first driver IC 201. The position of the first over-temperature protection sensor 2013 corresponds to the positions of all first voltage generators 2011_1~2011_*n***.

The second driver IC 202 may include a plurality of second voltage generators **2021_1~2021_*n*, a plurality of second electrical switches 2022_1~2022_*n*, and a second over-temperature protection (OTP) sensor 2023. The second OTP sensor 2023** may be implemented with a temperature sensor, but the invention is not limited thereto.

The second voltage generators **2021_1~2021_*n* are coupled to the PMIC 203. The outputs of the second voltage generators 2021_1~2021_*n* are respectively coupled to the inputs of the second electrical switches 2022_1~2022_*n*. The outputs of the second electrical switches 2022_1~2022_*n* are coupled to the display panel 22. The outputs of the second electrical switches 2022_1~2022_*n* are used as the outputs of the second driver IC 202. The PMIC 203 and the control terminals of the first electrical switches 2012_1~2012_*n* and the second electrical switches 2022_1~2022_*n* are coupled to the second OTP sensor 2023. In some embodiments of the invention, the PMIC 203 may be replaced with the external power terminal illustrated in FIG. 2**.

In a normal operation mode, the second OTP sensor 2023 turns on the first electrical switches **2012_1~2012_*n* and the second electrical switches 2022_1~2022_*n* since the second OTP sensor 2023 determines that the second working temperature is not substantially higher than the second given temperature. The PMIC 203 supplies power to the first voltage generators 2011_1~2011_*n* and the second voltage generators 2021_1~2021_*n*, and the first voltage generators 2011_1~2011_*n* and the second voltage generators 2021_1~2021_*n* responsively drive the display panel 22 through the first electrical switches 2012_1~2012_*n* and the second electrical switches 2022_1~2022_*n***.

When the second OTP sensor 2023 determines that the second working temperature is substantially higher than the second given temperature, the second OTP sensor 2023 turns off the first electrical switches **2012_1~2012_*n* and the second electrical switches 2022_1~2022_*n*, such that the outputs of the first electrical switches 2012_1~2012_*n* and the second electrical switches 2022_1~2022_*n* are in a high-impedance state. In some embodiments of the invention, when the second OTP sensor 2023 determines that the second working temperature is substantially higher than the second given temperature, the second OTP sensor 2023 may generate and transmit a second over-temperature protection (OTP) signal S2 to the PMIC 203. The PMIC 203 stops supplying power to the first voltage generators 2011_1~2011_*n* and the second voltage generators 2021_1~2021_*n* in response to the second OTP signal S2, such that the outputs of the first electrical switches 2012_1~2012_*n* and the second electrical switches 2022_1~2022_*n* are in a high-impedance state. The architecture in FIG. 16 may be applied to the architecture in FIG. 2 or the other embodiments, but the invention is not limited to such the display device 2 in FIG. 16. If the display device 2 in FIG. 16 is applied to the display device 2 in FIG. 13, the second OTP sensor 2023 may be coupled to the functional device 26. The functional device 24 may be coupled to the inputs of the first voltage generators 2011_1~2011_*n* and the second electrical switches 2022_1~2022_*n*. The second OTP sensor 2023 may transmit the second OTP signal S2 to the functional device 26** to perform a corresponding function.

Figure 17:
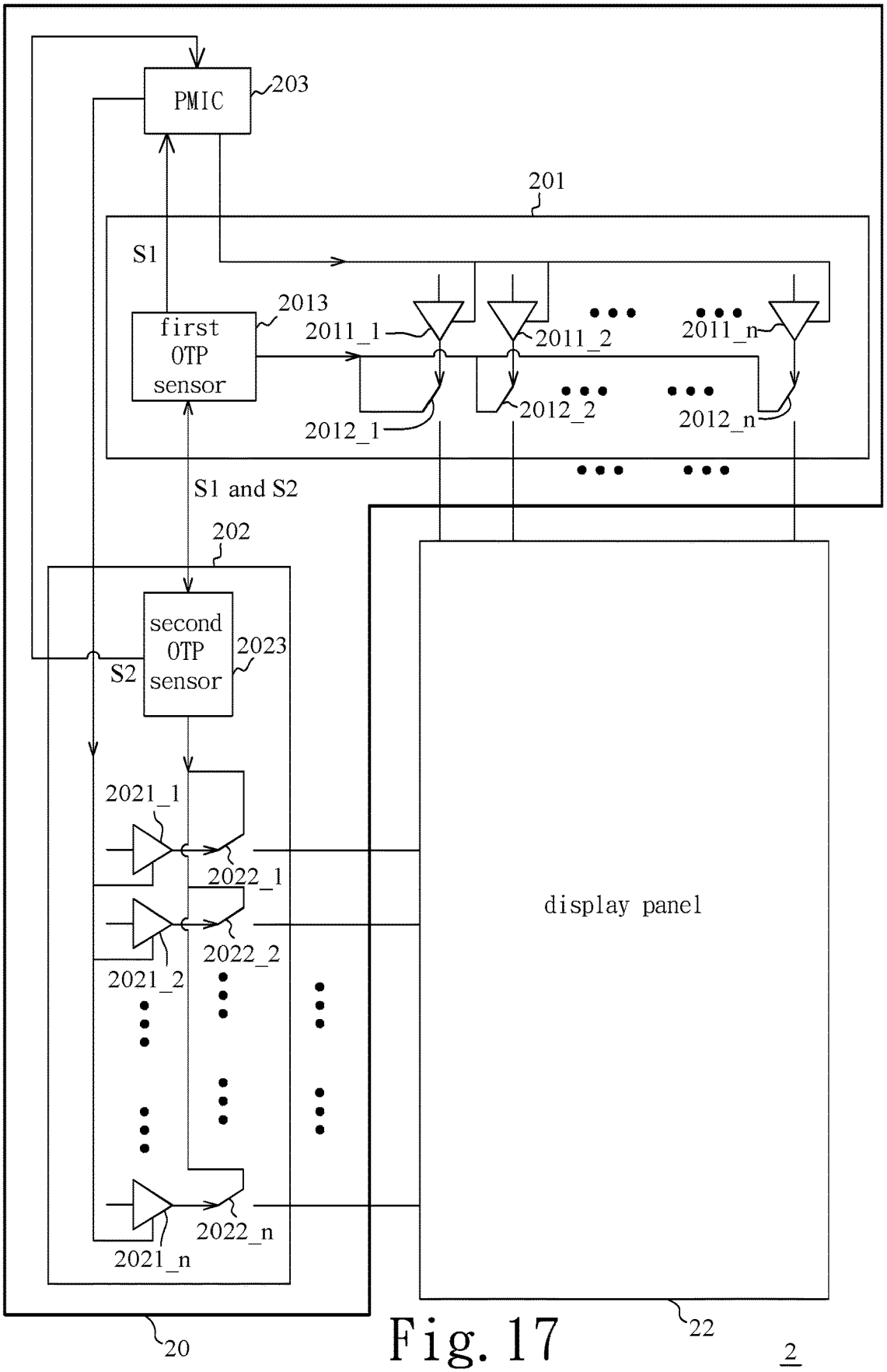
FIG. 17 is a diagram schematically illustrating a display device according to a tenth embodiment of the invention.

FIG. 17 is a diagram schematically illustrating a display device according to a tenth embodiment of the invention. Referring to FIG. 17, the tenth embodiment is introduced as follows. The first driver IC 201 of the tenth embodiment is the same to that of the eighth embodiment. The second driver IC 202 of tenth embodiment is the same to that of the ninth embodiment. The first OTP sensor 2013 and the second OTP sensor 2023 are coupled to each other.

In a normal operation mode, the first OTP sensor 2013 turns on the first electrical switches **2012_1~2012_*n* since the first OTP sensor 2013 determines that the first working temperature is not substantially higher than the first given temperature. The PMIC 203 supplies power to the first voltage generators 2011_1~2011_*n*, and the first voltage generators 2011_1~2011_*n* responsively drive the display panel 22 through the first electrical switches 2012_1~2012_*n*. In addition, the second OTP sensor 2023 turns on the second electrical switches 2022_1~2022_*n* since the second OTP sensor 2023 determines that the second working temperature is not substantially higher than the second given temperature. The PMIC 203 supplies power to the second voltage generators 2021_1~2021_*n*, and the second voltage generators 2021_1~2021_*n* responsively drive the display panel 22 through the second electrical switches 2022_1~2022_*n***.

When the first OTP sensor 2013 determines that the first working temperature is substantially higher than the first given temperature, the first OTP sensor 2013 turns off the first electrical switches **2012_1~2012_*n* and generates and transmits a first OTP signal S1 to the second OTP sensor 2023. The second OTP sensor 2023 turns off the second electrical switches 2022_1~2022_*n* in response to the first OTP signal S1. Thus, the outputs of the first electrical switches 2012_1~2012_*n* and the second electrical switches 2022_1~2022_*n* are in a high-impedance state. In some embodiments of the invention, the first OTP sensor 2013 may perform one of the following operations to communicate with the PMIC 203 when the first OTP sensor 2013** determines that the first working temperature is substantially higher than the first given temperature.

In the first operation, the first OTP sensor 2013 transmits the first OTP signal S1 to the PMIC 203, such that the PMIC 203 stops supplying power to the first voltage generators **2011_1~2011_*n* and the second voltage generators 2021_1~2021_*n* in response to the first OTP signal S1. As a result, the outputs of the first electrical switches 2012_1~2012_*n* and the second electrical switches 2022_1~2022_*n*** are in a high-impedance state.

In the second operation, the second OTP sensor 2023 transmits the second OTP signal S2 to the PMIC 203 in response to the first OTP signal S1. The PMIC 203 stops supplying power to the first voltage generators **2011_1~2011_*n* and the second voltage generators 2021_1~2021_*n* in response to the second OTP signal S2. As a result, the outputs of the first electrical switches 2012_1~2012_*n* and the second electrical switches 2022_1~2022_*n*** are in a high-impedance state.

When the second OTP sensor 2023 determines that the second working temperature is substantially higher than the second given temperature, the second OTP sensor 2023 turns off the second electrical switches **2022_1~2022_*n* and generates and transmits a second OTP signal S2 to the first OTP sensor 2013. The first OTP sensor 2013 turns off the first electrical switches 2012_1~2012_*n* in response to the second OTP signal S2. Thus, the outputs of the first electrical switches 2012_1~2012_*n* and the second electrical switches 2022_1~2022_*n* are in a high-impedance state. In some embodiments of the invention, the second OTP sensor 2023 may perform one of the following operations to communicate with the PMIC 203 when the second OTP sensor 2023** determines that the second working temperature is substantially higher than the second given temperature.

In the first operation, the second OTP sensor 2023 transmits the second OTP signal S2 to the PMIC 203, such that the PMIC 203 stops supplying power to the first voltage generators **2011_1~2011_*n* and the second voltage generators 2021_1~2021_*n* in response to the second OTP signal S2. As a result, the outputs of the first electrical switches 2012_1~2012_*n* and the second electrical switches 2022_1~2022_*n*** are in a high-impedance state.

In the second operation, the first OTP sensor 2013 transmits the first OTP signal S1 to the PMIC 203 in response to the second OTP signal S2. The PMIC 203 stops supplying power to the first voltage generators **2011_1~2011_*n* and the second voltage generators 2021_1~2021_*n* in response to the first OTP signal S1. As a result, the outputs of the first electrical switches 2012_1~2012_*n* and the second electrical switches 2022_1~2022_*n*** are in a high-impedance state.

The architecture in FIG. 17 may be applied to the architecture in FIG. 2 or the other embodiments, but the invention is not limited to such the display device 2 in FIG. 17.

According to the embodiments provided above, the display device and the driving device decrease temperature and avoid display problems to achieve complete protection and stability of the overall display device. The display device and the driving device even synchronously adjust and optimize the functionality in order to greatly improve application of the display device.

The embodiments described above are only to exemplify the invention but not to limit the scope of the invention. Therefore, any equivalent modification or variation according to the shapes, structures, features, or spirit disclosed by the invention is to be also included within the scope of the invention.

What is claimed is:

1. A display device comprising:

a display panel;

at least one first driver integrated circuit (IC) coupled to the display panel and configured to drive the display panel and detect a first working temperature; and at least one second driver integrated circuit (IC) coupled to the display panel and the at least one first driver IC and configured to drive the display panel, wherein the at least one first driver IC stops driving the display panel and communicates with the at least one second driver IC to stop driving the display panel when the first working temperature is substantially higher than a first given temperature.

2. The display device according to claim 1, wherein the at least one second driver IC is configured to detect a second working temperature, and the at least one second driver IC stops driving the display panel and communicates with the at least one first driver IC to stop driving the display panel when the second working temperature is substantially higher than a second given temperature.

3. The display device according to claim 1, wherein outputs of the at least one first driver IC are coupled to the display panel, and the at least one first driver IC stops driving the display panel due to a fact that the outputs of the at least one first driver IC are in a high-impedance state.

4. The display device according to claim 1, wherein outputs of the at least one second driver IC are coupled to the display panel, and the at least one second driver IC stops driving the display panel due to a fact that the outputs of the at least one second driver IC are in a high-impedance state.

5. The display device according to claim 1, further comprising a power management integrated circuit (PMIC), which is coupled to the at least one first driver IC and the at least one second driver IC and configured to supply power to the at least one first driver IC and the at least one second driver IC for driving the display panel.

6. The display device according to claim 5, wherein the at least one first driver IC communicates with the PMIC to stop supplying the power when the at least one first driver IC stops driving the display panel.

7. The display device according to claim 5, wherein the at least one second driver IC communicates with the PMIC to stop supplying the power when the at least one second driver IC stops driving the display panel.

8. The display device according to claim 1, wherein the at least one first driver IC is coupled to at least one functional device, and the at least one first driver IC communicates with the at least one functional device to perform a corresponding function when the first working temperature is substantially higher than the first given temperature.

9. The display device according to claim 1, wherein the at least one first driver IC is a source driver integrated circuit (IC) and the at least one second driver IC is a gate driver integrated circuit (IC).

10. The display device according to claim 1, wherein the at least one first driver IC is a gate driver IC and the at least one second driver IC is a source driver IC.

11. A driving device for driving a display panel comprising:

at least one first driver integrated circuit (IC) configured to drive the display panel and detect a first working temperature; and at least one second driver integrated circuit (IC) coupled to the at least one first driver IC and configured to drive the display panel, wherein the at least one first driver IC stops driving the display panel and communicates with the at least one second driver IC to stop driving the display panel when the first working temperature is substantially higher than a first given temperature.

12. The driving device according to claim 11, wherein the at least one second driver IC is configured to detect a second working temperature, and the at least one second driver IC stops driving the display panel and communicates with the at least one first driver IC to stop driving the display panel when the second working temperature is substantially higher than a second given temperature.

13. The driving device according to claim 11, wherein the at least one first driver IC stops driving the display panel due to a fact that outputs of the at least one first driver IC are in a high impedance.

14. The driving device according to claim 11, wherein the at least one second driver IC stops driving the display panel due to a fact that outputs of the at least one second driver IC are in a high-impedance state.

15. The driving device according to claim 11, further comprising a power management integrated circuit (PMIC), which is coupled to the at least one first driver IC and the at least one second driver IC and configured to supply power to the at least one first driver IC and the at least one second driver IC for driving the display panel.

16. The driving device according to claim 15, wherein the at least one first driver IC communicates with the PMIC to stop supplying the power when the at least one first driver IC stops driving the display panel.

17. The driving device according to claim 15, wherein the at least one second driver IC communicates with the PMIC to stop supplying the power when the at least one second driver IC stops driving the display panel.

18. The driving device according to claim 11, wherein the at least one first driver IC is coupled to at least one functional device, and the at least one first driver IC communicates with the at least one functional device to perform a corresponding function when the first working temperature is substantially higher than the first given temperature.

19. The driving device according to claim 11, wherein the at least one first driver IC is a source driver integrated circuit (IC) and the at least one second driver IC is a gate driver integrated circuit (IC).

20. The driving device according to claim 11, wherein the at least one first driver IC is a gate driver IC and the at least one second driver IC is a source driver IC.

* * * * *